US006202555B1

(12) United States Patent
Fischer

(10) Patent No.: US 6,202,555 B1
(45) Date of Patent: Mar. 20, 2001

(54) DRIVING MECHANISM FOR A CYLINDER OF A ROTARY PRINTING MACHINE

(75) Inventor: Christian Martin Michael Fischer, Marktheidenfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/424,233

(22) PCT Filed: May 26, 1998

(86) PCT No.: PCT/DE98/01432

§ 371 Date: Nov. 29, 1999

§ 102(e) Date: Nov. 29, 1999

(87) PCT Pub. No.: WO98/53995

PCT Pub. Date: Dec. 3, 1998

(30) Foreign Application Priority Data

May 28, 1997 (DE) ..... 197 22 379

(51) Int. Cl.[7] ..... B41F 13/00

(52) U.S. Cl. ..... 101/212; 101/217; 101/247; 101/142; 101/144

(58) Field of Search ..... 101/212, 216, 101/217, 218, 219, 142, 140, 144, 149, 177, 285, 247

(56) References Cited

U.S. PATENT DOCUMENTS

| | | | | |
|---|---|---|---|---|
| 2,821,134 | * | 1/1958 | Brodie | 101/217 |
| 3,769,910 | | 11/1973 | Heimlicher et al. . | |
| 4,072,104 | * | 2/1978 | Schaffer | 101/247 |
| 4,301,728 | * | 11/1981 | Jaffee et al. | 101/247 |
| 4,756,245 | * | 7/1988 | Roch | 101/247 |
| 4,945,830 | * | 8/1990 | Maehara | 101/217 |
| 5,159,878 | * | 11/1992 | Donelan | 101/217 |
| 5,423,254 | * | 6/1995 | Kimura et al. | 101/217 |
| 5,706,728 | * | 1/1998 | Motard et al. | 101/247 |

FOREIGN PATENT DOCUMENTS

| | | |
|---|---|---|
| 753695 | 11/1952 | (DE) . |
| 1113220 | 4/1960 | (DE) . |
| 1259356 | 1/1968 | (DE) . |
| 3704314 C1 | 1/1988 | (DE) . |
| 0644048 A2 | 12/1994 | (EP) . |

* cited by examiner

*Primary Examiner*—Eugene Eickholt
(74) *Attorney, Agent, or Firm*—Jones, Tullar & Cooper, PC

(57) ABSTRACT

A driving mechanism for a cylinder of a rotary printing machine utilizes a drive pinion that engages a drive gear of a cylinder which is supported in an eccentric bushing. The cylinder can be moved between print and non-print positions. The rotational axis of the drive pinion lies on a straight line defined by the axis of rotation of the cylinder and the axis of rotation of the eccentric bushing.

28 Claims, 2 Drawing Sheets

DRIVING MECHANISM FOR A CYLINDER OF A ROTARY PRINTING MACHINE

FIELD OF THE INVENTION

The present invention relates to a driving mechanism for a cylinder of a rotary printing press. This cylinder is seated in a eccentric bushing and carries a drive gear on a journal of the cylinder. The drive gear is engaged by a drive pinion.

DESCRIPTION OF THE PRIOR ART

EP 0 644 048 A2 describes a drive mechanism for a group of cylinders of an offset rotary printing press by means of a toothed belt.

DE 3704314 C1 describes an arrangement for adjusting the backlash between the drive wheels of sheet-transporting cylinders of a rotary printing press. In this device, each cylinder is pivotably seated in eccentric bushings.

SUMMARY OF THE INVENTION

The object of the present invention is based on providing a drive mechanism for a cylinder of a rotary printing press.

The object is attained in accordance with the invention by the arrangement of the axes of rotation of a shiftable transfer cylinder, a fixed drive and a fixed printing cylinder in a manner that will minimize gear backlash when the transfer cylinder is shifted.

The advantages which can be obtained by the present invention rest, in particular, in that in connection with cylinders, whose axis of rotation can be changed in location, or respectively in position, a change in the backlash between a toothed gear of the cylinder and an assigned drive pinion is minimized when the position is changed.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 2:
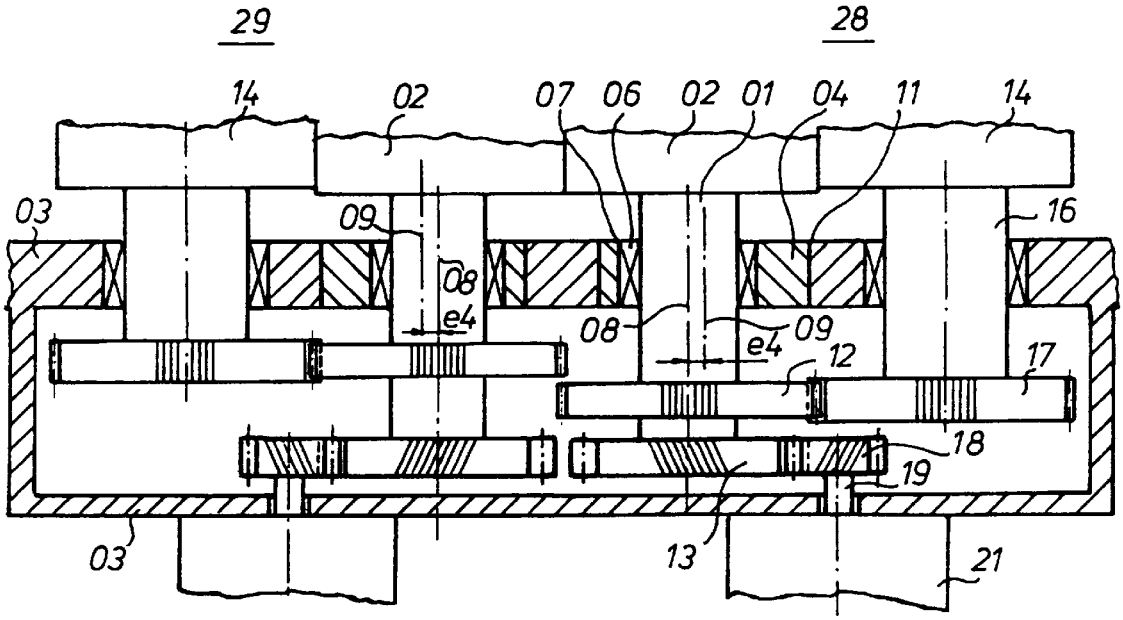
FIG. 2, a schematic top plan view on a drive mechanism of a cylinder; and in FIG. 3, an enlarged view of a portion of a drive mechanism, taken from FIG. 1.

A journal 01 of a rotating component 02, for example of a roller of an inking, or of a dampening system, or a journal of a cylinder 02 of a print unit, or respectively a folding apparatus, of a rotary printing press is seated in a side frame 03 in a manner wherein its location can be changed by means of an eccentric bushing 04, all as seen most clearly in FIG. 2. As may be seen, the journal 01 of the cylinder 02 is seated by means of a bearing 06 in a bore 07 of the eccentric bushing 04. A longitudinal axis 08 of this bore 07 of the eccentric bushing 04, i.e. the axis of rotation 08 of the cylinder 02, is offset by an eccentricity e4 in relation to a longitudinal axis 09 of an outer surface 11, i.e. a pivot axis 09 of the eccentric bushing 04. This eccentric bushing 04 is arranged in the side frame 03, and in rotable by means of a drive mechanism, not specifically represented. A first, for example a straight-fluted gear wheel 12, and a second, for example a helical gear wheel 13, for example a drive wheel 13, are arranged on the journal 01 of the cylinder 02.

In the present preferred embodiment, this cylinder 02 is designed as a transfer cylinder 02 of a print unit of an offset rotary printing press. A printing cylinder 14 is assigned to this transfer cylinder 02. On its journal 16, this printing cylinder 14 is provided with a gear wheel, for example a straight-fluted gear wheel 17. The first gear wheel 12 of the transfer cylinder 02 and the gear wheel 17 of the printing cylinder 14 are in engagement with each other, so that the transfer cylinder 02 and the printing cylinder 14 are interlockingly coupled for being driven by means of the gear wheels 12, 17 and constitute a first pair 28 of cylinders.

Preferably, this first pair 28 of cylinders is not interlockingly coupled with further cylinders for driving.

A drive pinion 18 is assigned to the second gear wheel 13 of the transfer cylinder 02. This drive pinion 18 may be arranged directly on a rotor 19 of a motor 21, whose position and/or rpm are controlled. The motor 21 is arranged, fixed in place, on the side frame 03. However, the drive pinion 18 can have its own support, independent of the rotor 19 of the motor 21, and can be connected via a coupling with the rotor 19 of the motor 21. Additional gear wheels can be interposed between the drive pinion 18 connected with the rotor 19 of the motor 21 and the second gear wheel 13 of the transfer cylinder 02. Preferably, the drive pinion 18 assigned to the rotor 19 of the motor 21 directly engages the gear wheel 13 of the transfer cylinder 02.

Figure 3:
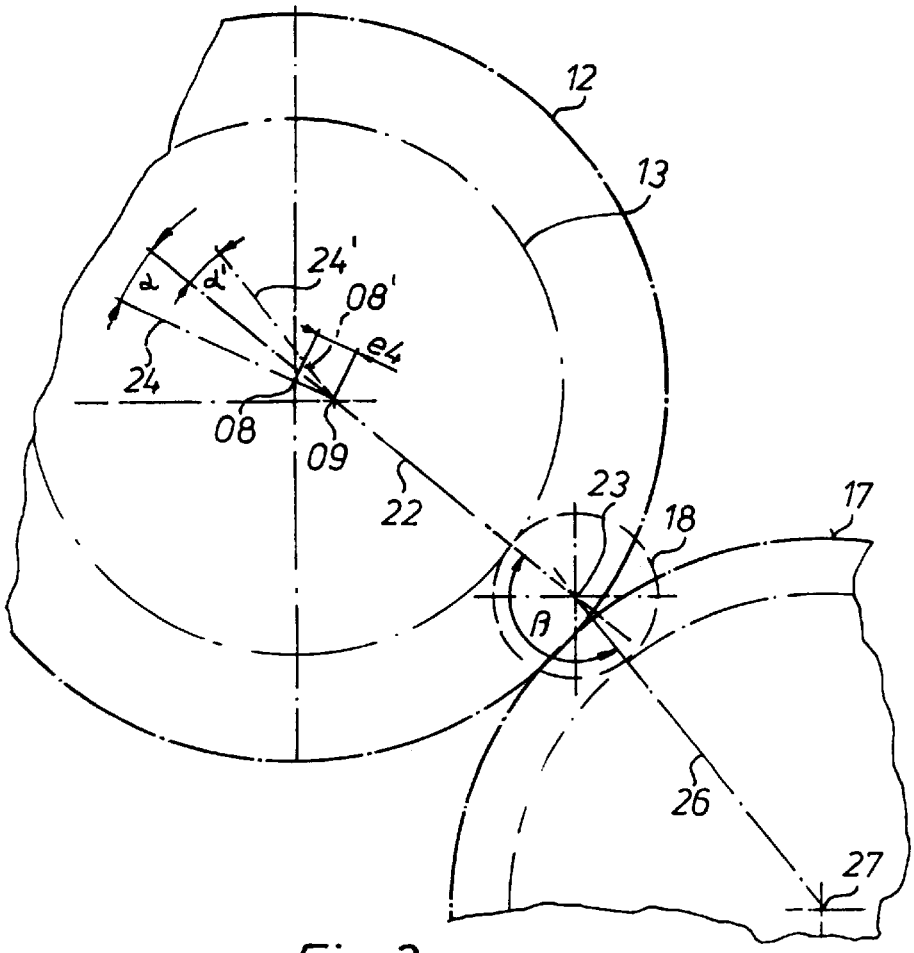
Figure 1:
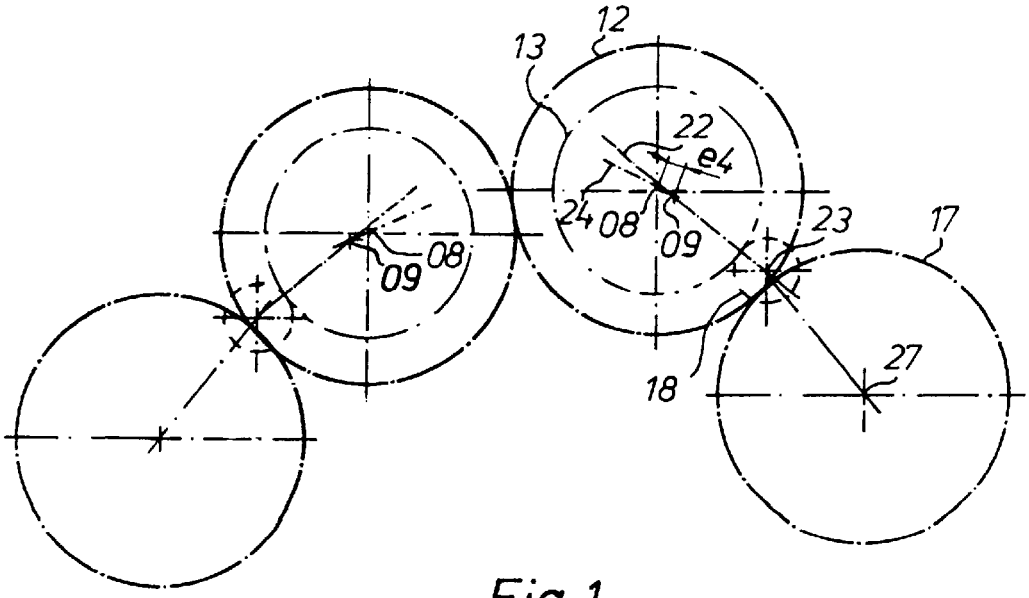
FIG. 1, a schematic side view of a drive mechanism of a cylinder.

A first straight line 22 is defined by an axis of rotation 23 of the drive pinion 18 and the pivot axis 09 of the eccentric bushing 04 as may be seen in both FIGS. 1 and 3.

A second straight line 24 extends through the axis of rotation 08 of the transfer cylinder 02 and the pivot axis 09 of the eccentric bushing 04 in a printing-on position.

In a printing-off position, the axis of rotation 08 of the transfer cylinder 02 is displaced into a position 08', and a straight line 24' extends through the axis of rotation 08' and the pivot axis 09 of the eccentric busing 04.

The first straight line 22 and the second straight line 24, or respectively 24', form an opening angle $\alpha$, or respectively $\alpha'$, in the printing-on position, or respectively in the printing-off position.

A value of this opening angle $\alpha$, for example 15° in the printing-on position, is approximately equal, with a maximum difference of $\alpha-\alpha'<10°$, and for example 5°, to a value of the opening angle $\alpha'$, for example −15°, in the printing-off position.

In the "printing-off" position, the axis of rotation 23 of a drive pinion 18, a pivot axis 09 of the eccentric bushing 04 and an axis of rotation of the cylinder 02 are approximately located on the same straight line.

A third straight line 26 is defined by an axis of rotation 27 of a second cylinder 14, for the axis of rotation of the printing cylinder 14, and the axis of rotation 23 of the drive pinion 18.

This third straight line 26 and the first straight line 22 form an opening angle $\beta$ of from 160° to 200°.

If the transfer cylinder 02 is placed against, or is moved away from the printing cylinder 14 by pivoting the eccentric bushing 04, a change in the backlash between the drive pinion 18 and the gear wheel 13 of the transfer cylinder 02 is minimal.

In the present preferred embodiment, the print unit is designed as a so-called bridge print unit. In this bridge print unit, a transfer cylinder 02 of a first pair 28 of cylinders, 02 and 04 works together with a transfer cylinder 02 of a second pair 29 of cylinders, as seen in FIG. 2. These two pairs 28, 29 of cylinders are preferably not interlockingly coupled with each other for being driven.

This first pair 28 of cylinders can also be used in so-called H-print units or in satellite print units.

It is also possible to drive only a single cylinder 02, or also a plurality of cylinders which, for the purpose of being a driven, are interlockingly coupled with each other, by means of a drive pinion 18 arranged in accordance with the present invention.

Pulleys can also be arranged in place of the drive pinion 18 and the drive wheel 13 of the cylinder 02, whose axes of rotation are arranged corresponding to the axes of rotation of the drive pinions 18 and the drive gear wheels 13 of the cylinders 02.

While a preferred embodiment of a driving mechanism for a cylinder of a rotary printing press in accordance with the present invention has been set forth filly and completely hereinabove, it will be apparent to one of skill in the art that a number of changes in, for example the type of printing being done, the material being printed on and the like could be made without departing from the true spirit and scope of the present invention which is accordingly to be limited only by the following claims.

What is claimed is:

1. A driving mechanism for cylinders of a rotary printing press comprising:

an eccentric bushing supported for rotation and having a bushing bore and a bushing pivot axis;

a transfer cylinder having a cylinder journal supported for rotation in said bushing bore and having a cylinder journal axis of rotation;

a drive wheel supported on said cylinder journal and useable to rotate the cylinder;

a drive pinion engagable with said drive wheel and having a drive pinion axis of rotation;

a first straight line defined by said drive pinion axis of rotation and said bushing pivot axis;

a second straight line defined by said bushing pivot axis and said cylinder journal axis of rotation, said first and said second straight lines intersecting and defining a first opening angle in the ranges between −20° and +20°';

a printing cylinder supported for rotation and having a printing cylinder axis of rotation; and a third line defined by said printing cylinder axis of rotation and said drive pinion axis of rotation, said third line intersecting said first line at a second opening angle in the range between 160° and 200°, said transfer cylinder and said printing cylinder directly contacting each other and forming a pair of cylinders.

2. The driving mechanism of claim 1 wherein a value of said first opening angle in a printing on position is approximately equal to a value of said first opening angle in a printing off position.

3. The driving mechanism of claim 1 wherein said d rive wheel is a gear wheel.

4. The driving mechanism of claim 1 wherein said drive wheel and said drive pinion are pulleys.

5. The driving mechanism of claim 1 wherein said transfer cylinder is a transfer cylinder of an offset rotary printing press.

6. The driving mechanism of claim 1 wherein said transfer cylinder is a printing cylinder.

7. The driving mechanism of claim 1 wherein said transfer cylinder is a counter-print cylinder.

8. The driving mechanism of claim 5 further including a printing cylinder interlockingly connected with said transfer cylinder.

9. The driving mechanism of claim 1 wherein said bushing pivot axis, said cylinder journal axis of rotation and said printing cylinder axis of rotation are located on a common straight line in a printing off position.

10. A driving mechanism for cylinders of a rotary printing press comprising:

an eccentric bushing supported for rotation and having a bushing bore and a bushing pivot axis;

a first cylinder including a cylinder journal supported in said bushing bore and rotatable about a cylinder journal axis of rotation;

a first drive wheel supported on said cylinder journal;

a drive pinion engageable with said first drive wheel and having a drive pinion axis of rotation;

a first straight line defined by said drive pinion axis of rotation and said bushing pivot axis;

a second straight line defined by said bushing pivot axis and said cylinder journal axis of rotation, said first and second straight lines intersecting at a first opening angle in the range of between +20° and −20°;

a second drive wheel supported coaxially with said first drive wheel; and a second cylinder having a third drive wheel, said second drive wheel being in engagement with said third drive wheel and having a second cylinder axis of rotation.

11. The driving mechanism of claim 10 wherein a value of said first opening angle in a printing on position is approximately equal to a value of said first opening angle in a printing off position.

12. The driving mechanism of claim 10 wherein said first, second, and third drive wheels are first, second and third gear wheels.

13. The driving mechanism of claim 10 wherein said first, second and third drive wheels, and said drive pinion are pulleys.

14. The driving mechanism of claim 10 wherein said first cylinder is a transfer cylinder of an offset rotary printing press.

15. The driving mechanism of claim 10 wherein said first cylinder is a printing cylinder.

16. The driving mechanism of claim 10 wherein said first cylinder is a counter-print cylinder.

17. The driving mechanism of claim 14 further including a printing cylinder interlockingly connected with said transfer cylinder.

18. The driving mechanism of claim 10 wherein said bushing pivot axis said cylinder journal axis of rotation, and said second cylinder axis of rotation are located on a common straight line in a printing off position.

19. A driving mechanism for a cylinder of a rotary printing press comprising:

an eccentric bushing supported for rotation and having a bushing bore and a bushing pivot axis;

a cylinder journal of the cylinder, said cylinder journal supported for rotation in said bushing bore and rotatable about a cylinder journal axis of rotation;

a drive wheel supported on said cylinder journal;

a drive pinion engageable with said drive wheel and having a drive pinion axis of rotation;

a drive motor having a rotor, said drive pinion being directly connected with said rotor;

a first straight line defined by said drive pinion axis of rotation and said bushing pivot axis; and a second straight line defined by said bushing pivot axis and said cylinder journal axis of rotation, said first and second straight lines intersecting at a first opening angle in the range of between +20° and −20°.

20. The driving mechanism of claim 19 wherein a value of said first opening angle in a printing on position is approximately equal to a value of said first opening angle in a printing off position.

21. The driving mechanism of claim 19 wherein said drive wheel is a gear wheel.

22. The driving mechanism of claim 19 wherein said drive wheel is a pulley.

23. The driving mechanism of claim 19 wherein the cylinder is a transfer cylinder of an offset rotary printing press.

24. The driving mechanism of claim 19 wherein the cylinder is a printing cylinder.

25. The driving mechanism of claim 19 wherein the cylinder is a counter-print cylinder.

26. The driving mechanism of claim 23 further including a printing cylinder interlockingly connected with said transfer cylinder.

27. The driving mechanism of claim 19 further including a second cylinder having a second cylinder axis of rotation and wherein said bushing pivot axis, said cylinder journal axis of rotation, and said second cylinder axis of rotation are located on a common straight line in a printing off position.

28. The driving mechanism of claim 22 wherein said axis of rotation of said transfer cylinder lies on a line defined by said drive pinion axis of rotation and said printing cylinder axis of rotation.

* * * * *